United States Patent [19]

Harris

[11] Patent Number: 4,526,479

[45] Date of Patent: Jul. 2, 1985

[54] ATHLETIC TIMER

[76] Inventor: Carl N. Harris, 2904 Augusta Dr., Durham, N.C. 27707

[21] Appl. No.: 639,490

[22] Filed: Aug. 10, 1984

Related U.S. Application Data

[63] Continuation-in-part of Ser. No. 338,288, Jan. 11, 1982.

[51] Int. Cl.[3] ..... G04B 37/00

[52] U.S. Cl. ..... 368/284; 368/108; 368/109

[58] Field of Search ..... 368/108, 109, 107, 89, 368/284

[56] References Cited

U.S. PATENT DOCUMENTS

| | | | |
|---|---|---|---|
| 4,104,861 | 8/1978 | Yoda et al. | 368/251 |
| 4,361,408 | 11/1982 | Wirtschafter | 368/109 |
| 4,492,479 | 1/1985 | Hatsuse et al. | 368/109 |

FOREIGN PATENT DOCUMENTS

| | | | |
|---|---|---|---|
| 67859 | 5/1980 | Japan | 368/109 |

*Primary Examiner*—Bernard Roskoski
*Attorney, Agent, or Firm*—B. B. Olive

[57] ABSTRACT

A self-contained, battery-powered, hand-held and finger-actuated timer produces switch controlled signals at a series of increasing time intervals for timing athletic games and in form which allows the user to retain visual contact with the game being timed and also so as to leave the user's fingers free for finger signaling, or the like.

2 Claims, 5 Drawing Figures

ATHLETIC TIMER

CROSS REFERENCE TO RELATED APPLICATION

This application is a continuation-in-part of prior application Ser. No. 338,288 filed Jan. 11, 1982, under the same title.

DESCRIPTION

1. Technical Field

The invention relates to a hand-held and finger-actuated battery-powered timer for producing signals at selected time intervals.

2. Background Art

The popularity of basketball has continued to grow from its crude beginning with a ball and a fruit basket. As the players have increased in their size and skills, and as the coaches have blended them more craftily into one smoothly functioning unit, rules have been set forth, modified and amended to ensure a balance between offense and defense, contact and injury, patience and stalling. Thus, rules have been adopted which will ensure and promote both player and spectator interest in the game of basketball. The enforcement and to some degree the interpretation of the rules fall to the game officials. The officials normally consist of a referee and one or two umpires assisted by two timers and two scorers. The rules demand that the officials calling the game be able to determine, accurately to the second how long a situation, condition, or incident exists, while at the same time watching ten players and a ball move rapidly around a playing area which may measure 94×50 feet. This is indeed a difficult task made more difficult by the level of intensity in a tightly contested game of great importance. Often the entire game hinges on just one call involving a violation of a time requirement.

The general object of this invention is thus to assist those officiating a basketball game by providing a simple, accurate and mobile timing device for individual use. It is easily seen, however, that the invention timing device is applicable to other sports.

DISCLOSURE OF INVENTION

The timing device of the invention is tubular in form, is held on the hand, and may be mounted on a finger or supported from the fingers of the user. Components in the housing, when activated and energized, produce a series of signals at desired time intervals, presently three, five and ten second intervals. A switching-timing circuit enables the operator to begin and terminate the sequence as desired. If not interrupted by the operator, the timing circuitry after completing a sequence assumes a standby state ready to initiate a new sequence.

BEST MODE FOR CARRYING OUT THE INVENTION

Figure 1:
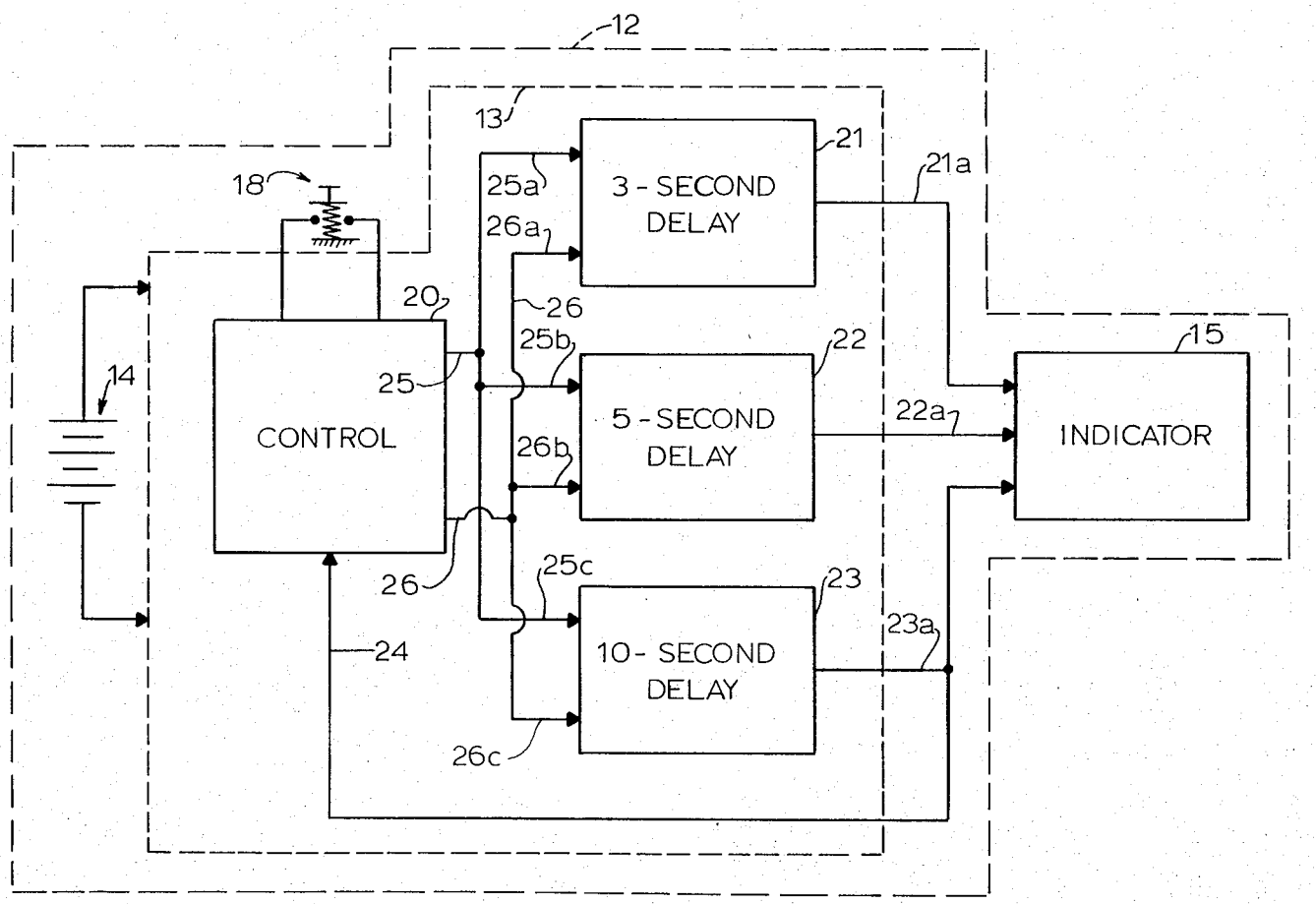
FIG. 1 is a schematic diagram of the circuitry of the invention device.
Figure 2:
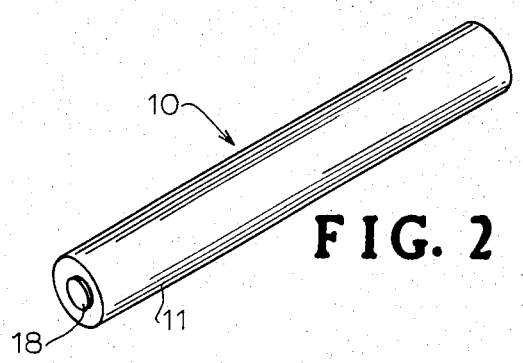
FIG. 2 is a perspective view of the dismounted invention athletic timer device.

The timing device 10 consists of a tubular housing 11 adapted to be held in the hand and which encloses the timing means 12, a block diagram of which is shown in FIG. 1. Timing means 12 comprises a battery 14, an indicator 15, a spring-loaded pushbutton switch 18, and timing circuitry 13 shown within the dashed lines in FIG. 1. Battery 14 provides power for timing circuitry 13 and indicator 15. The timing sequence is controlled and activated by the momentary, spring-loaded finger switch 18. Indicator 15 represents a device which informs the operator of the passage of the specified time intervals and may, for example, be a speaker, a beeper, a vibrator, or the like. Indicator 15 should produce a signal satisfying several criteria, namely, it must be sensed and understood by the official using the device, it must not distract the players or the coaches and it must be sensed without interrupting the user's visual contact of the play action. Hence, any form of dial or a series of lights such as on the typical readout stopwatch would be unacceptable signals for the invention. The preferred signal given by the indicator 15 within the housing is a tactile signal. In the preferred embodiment, indicator 15 comprises an electrically-operated tapping device which effectively taps or vibrates housing 11, preferably of metal or other material suited to transmitting taps or vibrations, in a manner the user can easily sense by tactility. Small electric vibrators suited to the invention are well known.

Figure 4:
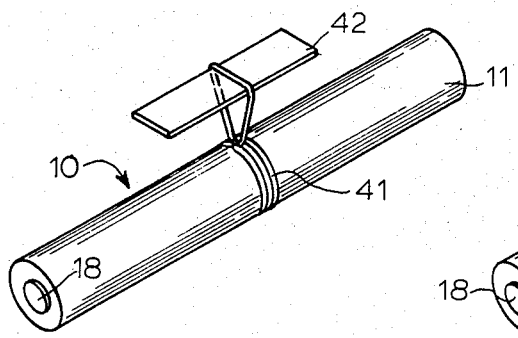
FIG. 4 is a perspective view of the invention athletic timer device with associated band and support which adapts for securing the device to the user's fingers and to be held in the user's hand as in FIG. 3.
Figure 5:
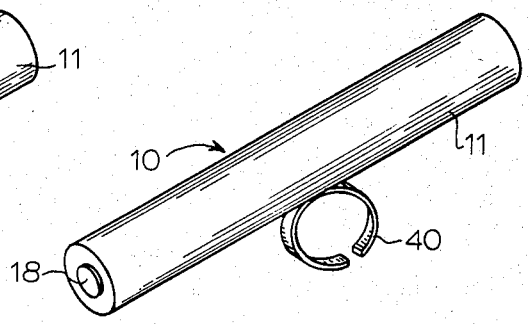
FIG. 5 is a perspective view of the invention athletic timer device removed from the hand and illustrating a housing with an integral ring as a mounting device.
Figure 3:
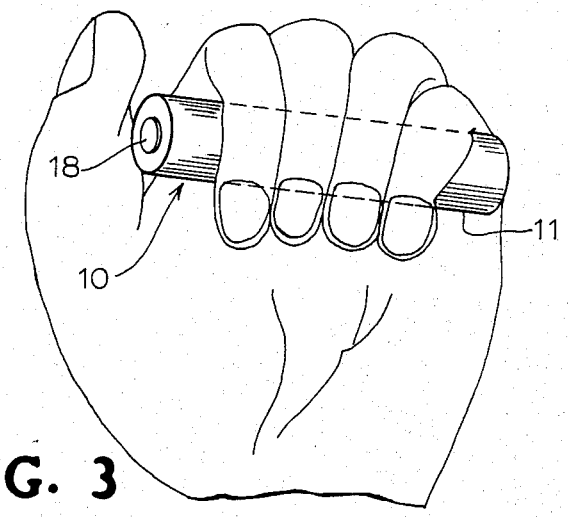
FIG. 3 illustrates how the invention athletic timer device appears as used when held in the hand of the timing official with the thumb opposed to the switch.

An important aspect of the invention timing device, particularly when used by a game official, resides in the ability to mount the invention in the hand or base of the fingers without interfering with the ability of the user to handle the ball, to hold up fingers to indicate the playing numbers of a player charged with a foul or to give other hand signals. Such mounting may be accomplished in any number of ways. The housing may have an integral part of it formed as a ring member 40 attached to it as illustrated in FIG. 5 with ring member 40 fitting on a finger. Another method is to attach the invention device to a glove, not shown, to be worn by the user. Still another method of mounting the device is to connect an elastic band, not shown, to each end of the tubular housing and stretch the band across the back of the hand. Another and preferred method is to use a closed circular rubber band, such as the illustrated band 41 in FIG. 4 which is first placed around the housing 11, approximately in the center as measured from end-to-end, then stretched between the middle and next finger (not illustrated) and is prevented from contracting by placing a small rigid member 42 equal in length to approximately the width of two fingers inside the loop and coming to rest across the back of the fingers. From such description, it can be seen that thumb operation of switch 18 and appropriate grasping of housing 11 are both easily achieved in a simple and practical manner. Further, by using an indicator 15 capable of producing a signal which can be sensed and understood by the official using the device, a signal that does not distract the players or coaches, and a signal which can be sensed without interrupting the user's visual contact of the play action, an overall extremely useful timing device for timing athletic events, and the like, is achieved.

Timing circuitry 13 as illustrated in block diagram form in FIG. 1 includes four fundamental blocks, namely, control block 20 and three timing blocks 21, 22, and 23. Descriptions of each of these blocks follow. From the description given, those skilled in the art will recognize various well-known electronic timing techniques applicable to the invention and various specific electronic circuitry within the timing blocks which might be designed for purposes of the invention.

Control block 20 is the element with which the operator interacts to control overall operation of timing device 10. Pushbutton switch 18 is connected to block 20. Control block 20 responds to momentary closures of the contacts of switch 18 and/or pulses received on its input wire 24 by entering one of two internal states, the "active" state or the "standby" state. When in the standby state, control block 20 is insensitive to pulses received on wire 24. Control block 20 remains in such standby state until the operator depresses the pushbutton switch 18. When switch 18 contacts close, control block 20 generates a pulse on its first output wire 25 which directs the timing blocks 21–23 to begin their timing intervals as described below, and then control block 20 enters the active state. When in the active state, control block 20 responds to either a pulse on its input wire 24 or another depression of the pushbutton switch 18 by reentering the standby state and putting out a pulse on its second output wire 26 which resets the timing blocks 21–23. Thus, control block 20 is a very simple finite-state machine with two states, the design of which can be implemented in any number of well-known ways.

The three timing blocks 21–23 are identical to each other in operation, except for the duration of the time intervals they generate. Each represents an electronic circuit with two input wires and one output wire. Input wire 25 is connected to the respective timing blocks 21–23 through the connecting lines 25*a*, 25*b* and 25*c*. Input line 26 is connected to the respective timing blocks 21–23 through lines 26*a*, 26*b* and 26*c*. The respective timing block output lines are identified as output lines 21*a*, 22*a*, 23*a*. When a pulse is received at the first input wire 25, each timing block starts its timing cycle of the indicated number of seconds. At the end of each respective interval, each respective timing block generates a pulse on its output wire, i.e., line 21*a*, 22*a*, or 23*a*, illustrated at the right hand side of each respect:ve timing block in FIG. 1. If, between the time of the arrival of the pulse on line 25 and the time of the generation of the output pulse on the respective output lines 21*a*, 22*a*, and 23*a*, a pulse arrives on the other input line 26, each timing block which has not completed its timing cycle terminates such timing cycle without generating the corresponding output pulse, and returns to the state in which it waits for another pulse on line 25. Pulses received on line 26 at the timer block input have no effect on any timing block which is not currently generating its time interval in response to a previous pulse received on line 25. As each of the three timing blocks completes its timing cycle, such block generates a pulse on its respective output wire 21*a*, 22*a*, or 23*a* which then triggers indicator 15 to give the operator an appropriate indication of the passage of that time interval such as by the previously mentioned tactile, sound or beep signal.

The operation of the overall timing means involves the interaction of the various blocks shown in FIG. 1. Initially, control block 20 is in its standby state and timing blocks 21–23 are idle. When the operator pushes the pushbutton switch 18, control block 20 generates a pulse on line 25 to cause timing blocks 21–23 to begin their respective timing sequences. Control block 20 then enters its active state. At this point, the operator can terminate the timing sequences with another push of pushbutton switch 18, which causes control block 20 to enter its standby state again and generate a pulse on line 26 which, in effect, commands the timing blocks 21–23 to interrupt their sequences. If the operator chooses not to terminate the sequence using pushbutton switch 18, then after each of the specified time delays, the respective timing blocks 21–23 will produce pulses at their outputs causing the indicator 15 to signal the operator. Finally, when the 10-second timing block 23 produces its output pulse on line 23*a*, that signal is also connected back through line 24 at the input of control block 20 to cause control block 20 to return to its standby state, ready for another push of pushbutton swich 18 to reinitiate the chain of events described above.

In summary, the game official is now given a device capable of being mounted within his hand, of leaving the hand on which the device is mounted and its fingers free for handling a ball or signaling, of producing a signal that can be sensed and understood without distracting players or coaches and of being used without loss of visual contact with the play action.

What is claimed is:

1. A hand-mountable timing device for use by a person for timing a selected athletic event requiring timing of penalty situations according to different lengths of time, comprising:

(a) a tubular housing sized for being gripped by the fingers and positioned on the hand with one end juxtapositioned the thumb of the user;

(b) means secured to said housing for releasably securing said housing to one hand of the said person performing the timing in a manner enabling said housing to be gripped by the fingers or to remain in place without being gripped and enclosed by the fingers of said hand so as to leave said hand and its fingers free for handling a ball or signaling while said housing remains secured to said hand and while simultaneously positioned with one end of said housing opposite said thumb of said hand;

(c) timing means enclosed by said housing, said timing means having a power supply and single switch controllable timing means operative under single switch control to generate, start, stop and reset for restarting a series of time spaced signals and indicator means for expressing said signals in a form adapted to be sensed and understood by the person using the device and performing the timing without such person losing visual contact with the event being timed and indicative of time allocated a given penalty situation; and (d) a manually operable momentary switch mounted in said end of said housing proximate said thumb and operatively associated with said timing means, said switch by successive actuation thereof by said thumb being adapted to start, stop and reset said timing means.

2. A hand-mountable timing device as claimed in claim 1 wherein said means for expressing said signals is a tactile-type device.

* * * * *